United States Patent [19]

Golden

[11] Patent Number: 4,928,574

[45] Date of Patent: May 29, 1990

[54] AMMUNITION MAGAZINE SYSTEM

[75] Inventor: Michael D. Golden, Corona del Mar, Calif.

[73] Assignee: Western Design Corporation, Irvine, Calif.

[21] Appl. No.: 104,786

[22] Filed: Oct. 5, 1987

[51] Int. Cl.[5] ..... F41F 9/06

[52] U.S. Cl. ..... 89/34; 89/36.13

[58] Field of Search ..... 42/89; 89/34, 36.08, 89/36.13

[56] References Cited

U.S. PATENT DOCUMENTS

| | | | |
|---|---|---|---|
| 394,373 | 12/1888 | Kelton | 42/89 |
| 2,396,184 | 3/1946 | Lima | 42/89 |
| 3,140,639 | 7/1964 | Werner | 89/36.08 |
| 3,670,623 | 6/1972 | Kuyper | 89/34 |
| 3,724,324 | 4/1973 | Zielinski | 89/36.13 |
| 3,786,715 | 1/1974 | Even | 89/36.08 |
| 3,890,733 | 6/1975 | Kubik | 42/89 |
| 4,535,677 | 8/1985 | Panhke et al. | 89/34 |
| 4,768,418 | 9/1988 | Blommer et al. | 89/34 |

FOREIGN PATENT DOCUMENTS

| | | | |
|---|---|---|---|
| 59103 | 3/1938 | Norway | 42/89 |
| 476284 | 9/1969 | Switzerland | 89/34 |

*Primary Examiner*—Stephen C. Bentley

*Attorney, Agent, or Firm*—Walter A. Hackler

[57] ABSTRACT

An ammunition magazine is provided for a large caliber gun installed on a vehicle in which the magazine is attached to the vehicle in a manner enabling the magazine to be moved from the first position at which ammunition can be moved from the magazines from within the vehicle to a second position at which ammunition rounds can be inserted into the magazine from outside the vehicle. The magazine itself is made of a plurality of attached modular canisters, with each modular canister being configured for supporting an ammunition round and including means for attaching each modular canister to other modular canisters to form a monocoque structure.

17 Claims, 4 Drawing Sheets

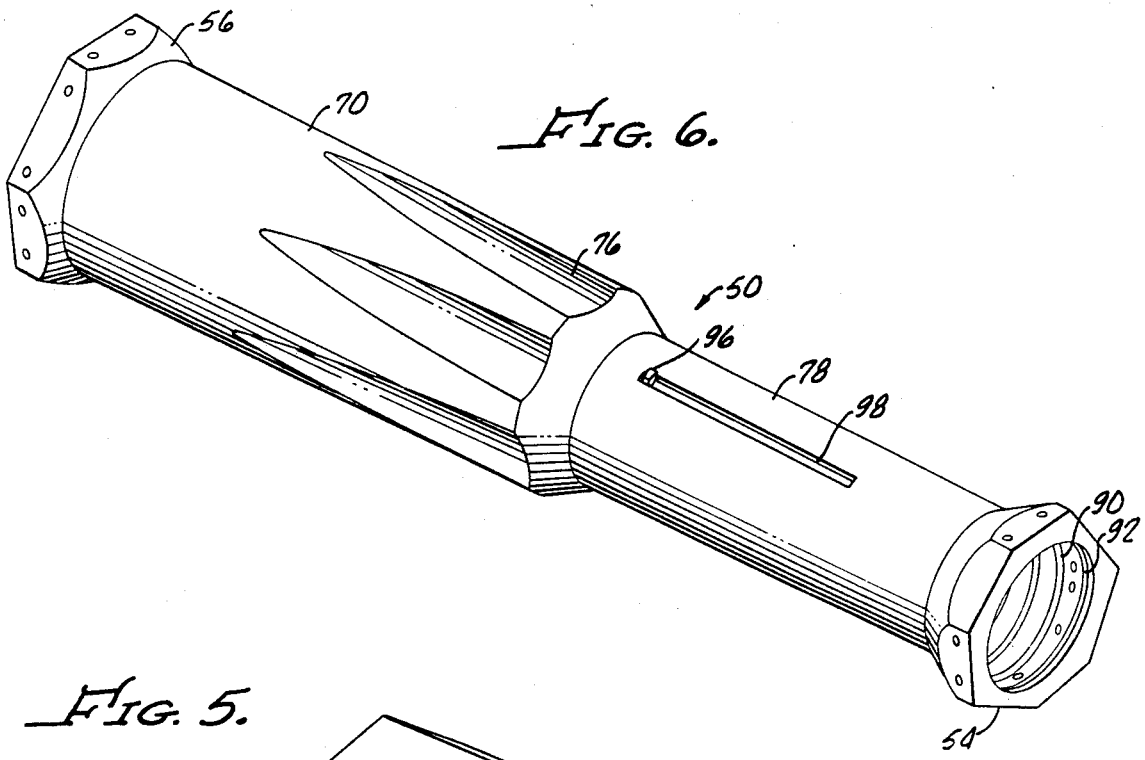
FIG. 6.
FIG. 5.
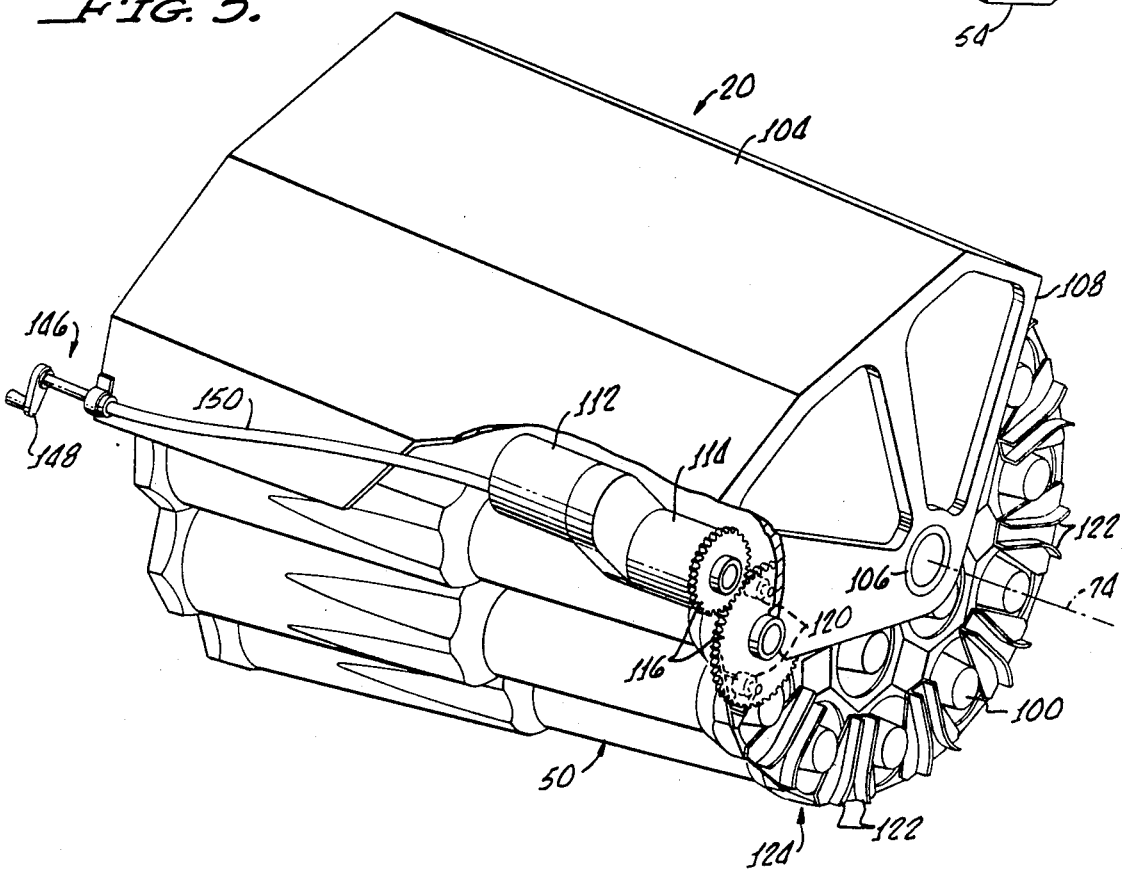

AMMUNITION MAGAZINE SYSTEM

The present invention relates generally to ammunition magazine systems and more particularly is directed to a magazine system having a lightweight monocoque magazine structure and a system for mounting the magazine to a vehicle to enable rapid separation of the magazine from the vehicle in the event of hazardous conditions, which may occur in the magazine as a result of fire or damage caused by enemy attack.

Combat vehicles, such as tanks, provide a limited envelope for mounting of necessary armament and impose severe constraints on acceptable positions for ammunition magazines.

Because the tank and gun system typically require personnel for the operation thereof, the storage of ammunition for future use is hazardous. In order to protect ammunition handling personnel, the magazines are typically enclosed in armor plate and access thereto is limited.

Heretofore, in a typical installation, the magazine includes a rectangular structure having compartments therein for each round of ammunition and the magazine is typically separated from personnel by an armor plate door, which is opened and closed by the handler during the removal of ammunition therefrom. Often the magazine and gun system is designed for the handling and firing of more than one kind of ammunition; for example, high explosive (HE) ammunition, and armor piercing (AP) ammunition. In this instance, designated compartments of the magazine are utilized to store a specific kind of ammunition.

In order to reduce the possibility of detonation of one or more of the rounds in the magazine due to enemy attack, fratricide protection between the compartments may be used. In this manner the risk of a chain-reaction-type explosion, which may occur with one round igniting the next is lessened. This fratricide protection typically includes steel reinforced polyethylene pieces designed to intercept and slow down any exploded warhead fragments and to prevent them from entering in the adjacent compartments. However, even this type of protection is many times insufficient in protecting both the personnel and the tank itself.

As may be expected, a large number, for example, 18 or more rounds of ammunition, such as 120 mm, may be stored in the magazine and available for firing by the gun. When the door to the ammunition magazine is open, it should be appreciated that the personnel are vulnerable should the magazine be hit by enemy fire. Unfortunately, with a fixed magazine, the doors are quite large, for example, up to 12–13 square feet for 120 mm, in order to allow access to the entire magazine and necessarily require more time for opening and closing them. Even though these doors are power-driven, fractions of a second are important when exposure to an open or partially open magazine, when it is hit by oncoming enemy fire.

Another disadvantage of magazines in current use, is the fact that an operator unloading ammunition from an array of compartments can err in the selection of ammunition due to confusion during battle. This is unfortunate because a mistakenly delivered armor piercing round, which is fired by a gun ballistically set up to fire a high energy round, will most certainly miss the target. Also, while manual removal of ammunition rounds from a magazine of fixed compartments seems relatively simple, it should be appreciated that 120 mm rounds typically weigh about 50 pounds and because different types of rounds are disposed throughout the magazine at various distances above the deck, chances of misselection and/or dropping an ammunition round can be appreciable under the urgency of combat.

Another consideration in the design of a vehicle borne ammunition magazine, is the overall weight and size of the magazine. Dense packing of the ammunition is desirable; however, fratricidal protection may also be required as hereinabove mentioned.

The present invention overcomes the hereinabove recited disadvantages and provides for an ammunition magazine assembly which enables dense packing of ammunition and a lightweight structure which may be mounted for rotation on the vehicle. In addition, the system provides for rapid ejection of the entire magazine should it become hazardous, thus protecting both the personnel and the vehicle itself.

As hereinafter set forth, the rotational mounting of the ammunition magazine enables a handler to remove ammunition from the magazine without undergoing severe translation of movement. It also enables the elimination of large doors heretofore necessary and consequently provides for safer storage of the ammunition rounds during use.

SUMMARY OF THE INVENTION

The ammunition magazine assembly, in accordance with the present invention, for a large caliber gun installed in a vehicle, includes magazine means for supporting a plurality of ammunition rounds and means of attaching the magazine to the vehicle for enabling the magazine means to be moved from a first position, at which the ammunition rounds can be removed from the magazine means from within the vehicle, to a second position, at which the ammunition rounds can be inserted into the magazine means from outside the vehicle.

More particularly, the means attaching the magazine means to the vehicle may include hinge means for enabling the magazine means to be rotated from the first to the second position. Additionally, means may be provided for separating the magazine means from the vehicle when the magazine means is in the second position. In this manner the entire magazine may be dropped, or ejected, from the vehicle in case a hazardous condition should occur within the magazine. That is, if fire should occur within the magazine, it can be rotated from the first position to the second position and then released, or ejected, from the vehicle.

More specifically, the ammunition magazine assembly, in accordance with the present invention, includes a plurality of modular canisters, with each modular canister being configured for supporting an ammunition round and having means for attaching each modular canister to other modular canisters to form a monocoque structure. In this manner support structure, such as large end plates for holding the magazine together, is eliminated, resulting in an ammunition magazine assembly having lighter weight than heretofore available ammunition magazines.

In addition, the means for attaching each modular canister to other modular canisters comprises means for attaching each modular canister to four other modular canisters and, also, aligning the attached modular canisters in a circular array about a centerline of the ammunition magazine.

Further, the means for attaching each modular canister to two other modular canisters includes means for removably making such attachment. This provides an advantage in providing for on-site maintenance or repair of the magazine.

In order to further reduce the overall envelope of the ammunition magazine assembly and thereby increase the storage density of the ammunition therein, the means for attaching each modular canister to other modular canisters includes means for aligning the longitudinal axis of each modular canister so that the longitudinal axes of each modular canister converges toward one another.

More specifically, the means for attaching each modular canister to other modular canisters comprises a heptagon shaped ring disposed proximate each end of each modular canister. Upon assembly, the modular canisters are attached to other modular canisters by inserting bolts through holes provided in the heptagon shaped rings.

The ammunition magazine assembly, according to the present invention, may also include means for mounting the monocoque structure for rotation about a centerline thereof and anti-fratricide means may be disposed between each modular canister for retarding fratricidal detonation of ammunition rounds disposed in an adjacent modular canister.

Additionally, means for indexing the monocoque structure may be provided to enable the monocoque structure to be rotated so that each modular canister can be sequentially stopped at a preselected position. The magazine assembly may then further include a barrier disposed adjacent one side of the monocoque structure and having port means therein to enable access through the barrier to remove ammunition rounds from a modular canister stopped at the preselected position. Because the port need be sized to allow only one or two ammunition rounds to pass therethrough, doors covering the port are significantly smaller than the large access doors heretofore required with prior art magazines.

More specifically, each ammunition canister, according to the present invention, includes a generally cylindrical body which is configured for supporting an ammunition round therein and attachment means for mounting the cylindrical body to a plurality of other cylindrical bodies identical to the first mentioned cylindrical body in a honeycomb pattern. Additionally, each cylindrical body includes a neck portion and a body portion, with the neck portion having a smaller diameter than the body portion and the ammunition canister may further include spring means deposed in the neck portion for maintaining the ammunition round in compression within the cylindrical body.

Since the ammunition intended to be stored in the magazine assembly of the present invention includes casings of combustible material which have relatively weak tensil strength, the present invention provides for holding the ammunition rounds in compression to enhance the structural integrity of the rounds while disposed in the magazine. This is important since, during attack, severe external mechanical forces may be exerted on the magazine assembly.

Ammunition magazines in accordance with the present invention for small caliber ammunition, such as, for example, 20 mm, or the like, may be in the form of a single piece injection molded plastic honeycomb-like module. Although this latter embodiment does not have the advantage of assembly and disassembly of the hereinabove described embodiment, it nonetheless achieves a greater packing density for ammunition than conventional small caliber ammunition magazines.

BRIEF DESCRIPTION OF THE DRAWINGS

A better understanding of the present invention may be had from the consideration of the following detailed description, taken in conjunction with the accompanying drawings in which:

FIG. 5 is a perspective view of the magazine assembly and means for mounting the magazine assembly for rotation on the tank, partially broken away to show means for indexing the monocoque structure so that it can be rotated to sequentially stop modular canisters at a preselected position for alignment with the ammunition port shown in FIG. 2;

FIG. 6 is a perspective view of a modular canister and means for attaching the modular canister to other modular canisters to form the magazine assembly shown in FIGS. 3 and 4;

DETAILED DESCRIPTION

Figure 1:
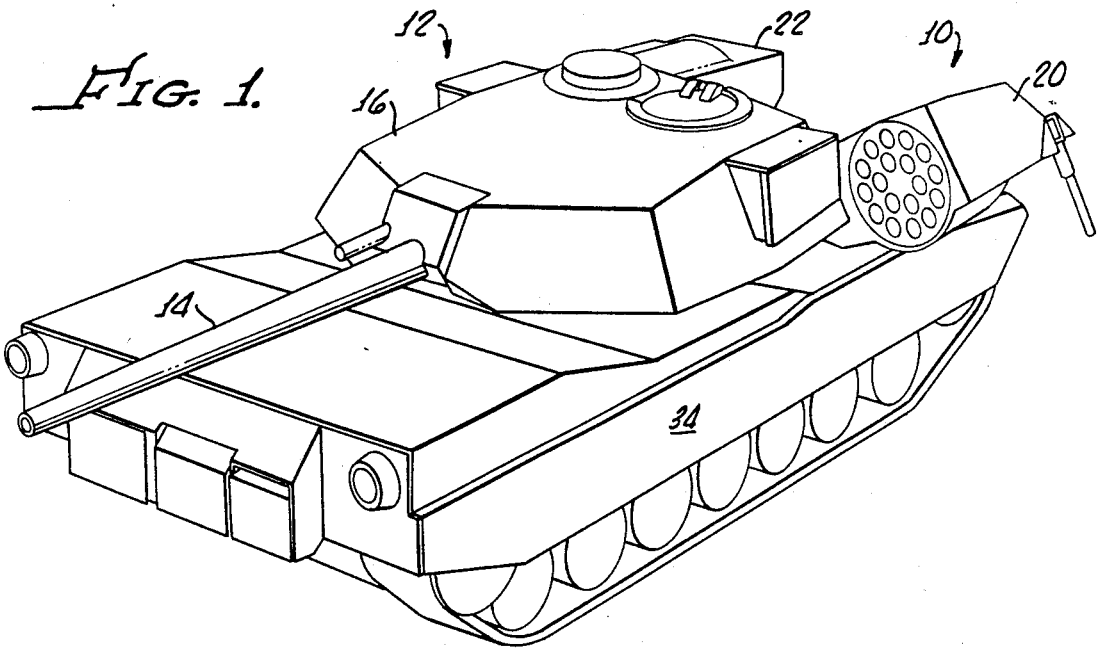
FIG. 1 is a perspective view of an ammunition magazine system in accordance with the present invention, shown as it may be installed on a tank, with one magazine shown in a position for facilitating loading of the magazine from outside the tank.
Figure 2:
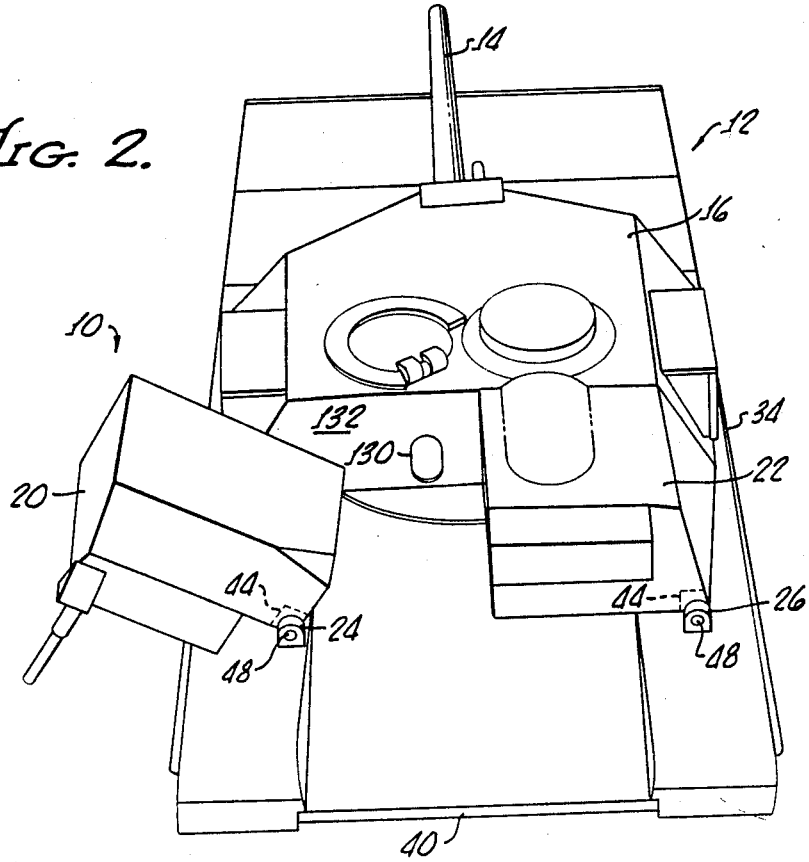
FIG. 2 is another perspective view of the ammunition magazine system showing the rear of the tank and an ammunition port for passing ammunition from the magazine into the tank turret when the magazine is rotated into an operative position therewith.

Turning now to FIGS. 1 and 2, there is shown in perspective, an ammunition magazine system 10 in accordance with the present invention installed on a tank vehicle 12 having a gun 14 mounted for loading from inside a tank turret 16. The ammunition magazine system 10 generally includes magazines 20, 22, each providing means for supporting a plurality of ammunition rounds (not shown in FIGS. 1 and 2), as will hereinafter be discussed in greater detail, and hinges 24, 26 which provide means for attaching the magazines 20, 22 to the tank 12 for enabling the magazines 20, 22 to be moved from a first position, as indicated by the magazine 22 in FIGS. 1 and 2, at which ammunition rounds can be removed from the magazine from within the vehicle, to a second position, as indicated by the position of magazine 20 in FIGS. 1 and 2, at which ammunition rounds can be inserted into the magazine 20 from outside the vehicle 12.

Access to the magazine 20 from a side 32 of the tank 12 is clearly shown in FIG. 1.

The magazine 22 is similarly mounted as that of the magazine 20 to enable the movement, or rotation, thereof to mirror image positions of magazine 20 to both enable removal of ammunition rounds from within the vehicle and loading of the magazine 22 from along an opposite side 34 of the vehicle.

Although the magazines 20, 22 are mounted for rotation about hinges 24, 26, respectively, along an axis generally parallel with the longitudinal axis of the tank (not shown), it should be appreciated that the magazines 20, 22 may also be mounted for rotation about a transverse axis (not shown), to enable rotation of the magazines 20, 22 rearwardly to enable loading of the magazines from outside a rear of the tank.

An important feature of the present invention is the provision for releasing the magazines 20, 22 when they are tilted outwardly as shown by magazine 20 in FIGS. 1 and 2 in order to drop or jettison the magazines 20, 22 on command should hazardous conditions develop within the magazine.

This may be provided by incorporating an explosive charge 44 disposed for ejecting hinge pins 48 or any suitable method for separating pivotal attachment between two members.

Figure 3:
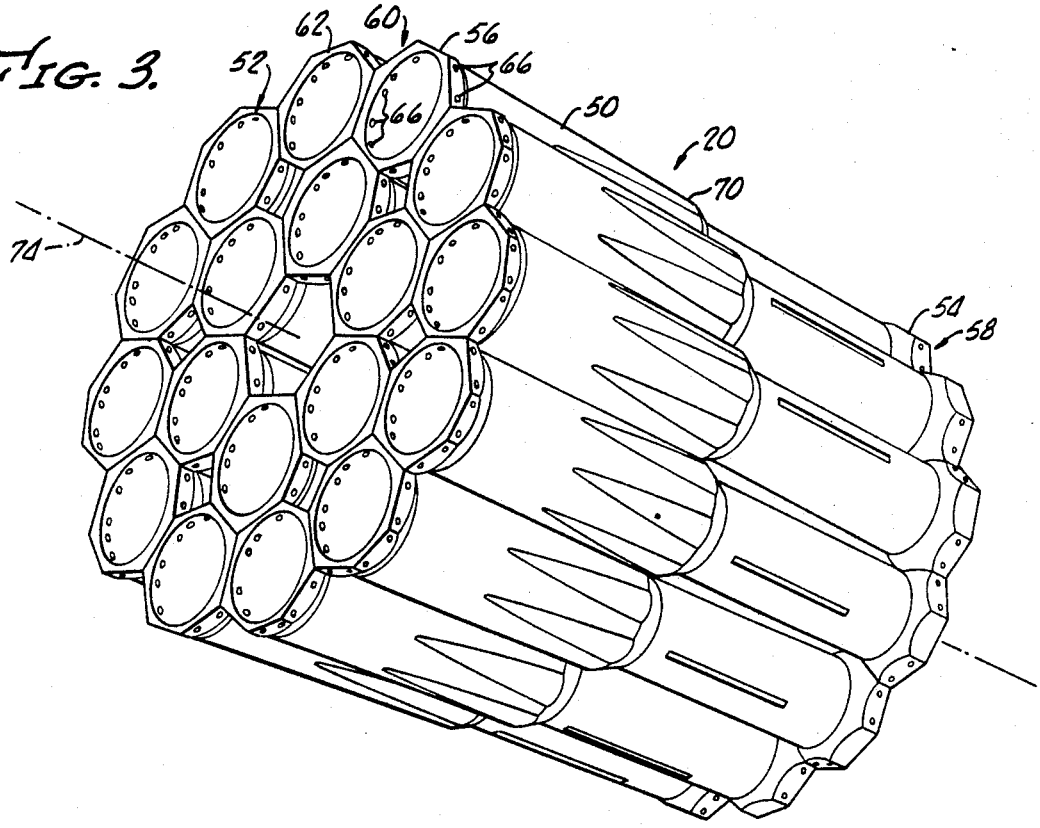
FIG. 3 is a perspective view of one end of an ammunition magazine assembly in accordance with the present invention showing a plurality of attached modular canisters.
Figure 4:
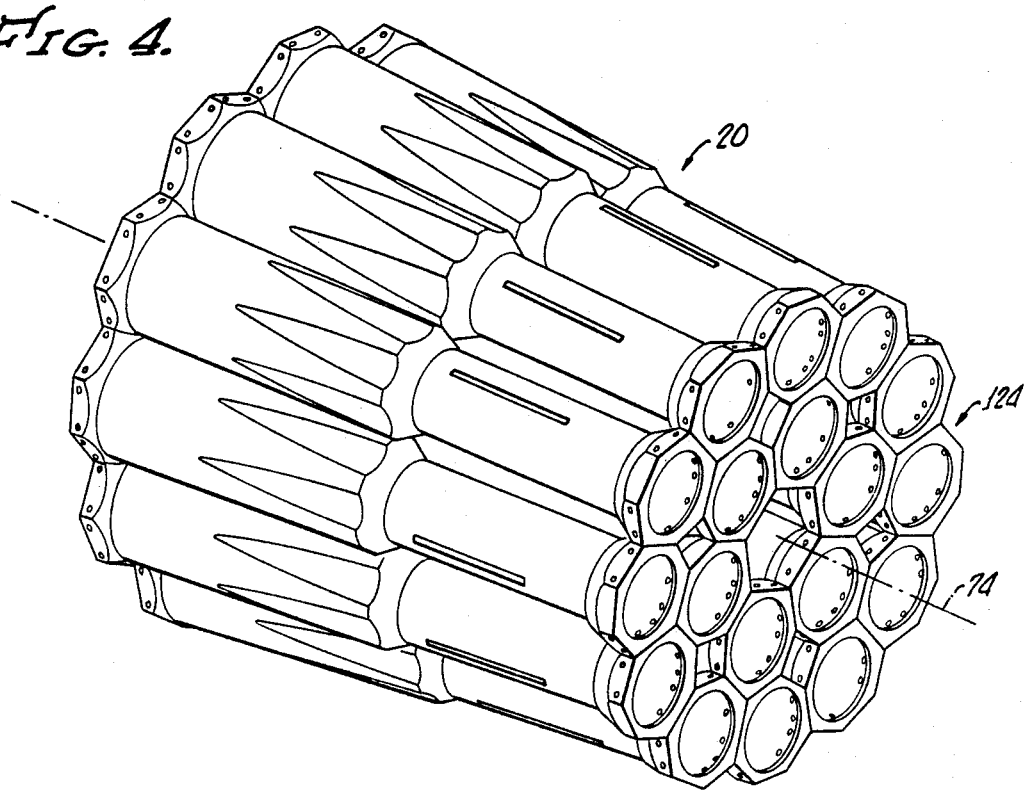
FIG. 4 is a perspective view of another end of the ammunition magazine assembly.

Turning now to FIGS. 3, 4 and 5, there is shown a magazine 20 in accordance with the present invention which includes a plurality modular canisters 50 attached to one another, with each modular canister 50 being configured for supporting an ammunition round such as a 120 mm. Each of the modular canisters 50 includes a mounting ring 54, 56 molded or attached to forward and rearward ends 58, 60 which includes mounting holes 66, which provides means for attaching each modular canister 50 to other modular canisters 52, 54, by way of bolts (not shown), or the like. The canisters 50 may be formed from high pressure aluminum die castings with the exterior facets 62 on the rings 54, 56 and inside diameter of the canister 50 machined in a conventional manner.

Hence, the modular ammunition canister 50, with its generally cylindrical body 70 and rings 54, 56, provide full monocoque bolt-together structure, which requires no separate structural attachment as in conventional magazines. This provides not only for a strong integrity, but also significantly reduces the overall weight of the magazine because no excess structure is required.

Specifically, the mounting rings 54, 56, may be in the shape of a prismatic heptagon which provides means for attaching each modular canister 50 with up to four other modular canisters. In addition, the rings 54, 56 provide means for aligning the attached modular canisters 50, 52 in a circular array about a centerline 74. It is also important that, in accordance with the present invention, the utilization of the rings 54, 56 and mounting holes 66, enables the canisters 50, 52 to be removably attached to one another which facilitates the disassembly of the magazine and replacement of damaged canisters and, importantly, the assembly of new magazines from partially destroyed older magazines. It should be appreciated that this significantly reduces the cost of servicing the magazines and for replacing magazines in combat situations where otherwise the tank would have to be recalled and serviced at a factory-type facility.

The rearward heptagonal ring 56 may be of greater diameter than the forward heptagonal ring 58 in order to provide a means for causing the longitudinal axes of the modular canister 50 to converge toward one another. This has as an advantage, increase packing density.

It should also be appreciated that the magazine assembly as shown in FIGS. 3 and 4 is not limited in its application to tank vehicle-type installations but is useful when any installation where the size and weight of the ammunition magazine are important considerations.

As hereinabove noted, the present invention may also be used to advantage in magazines for small caliber ammunition. In this instance, the magazine as shown in FIGS. 3 and 4 may be formed from a single piece of injected molded plastic. The resulting honeycomb-like module has an inherent strength which negates the need to use a high strength reinforced plastic.

The conical round orientation of all embodiments of the present invention provides for optimum round packaging density and reduced module material volume.

Although shown in FIGS. 3 and 4 as general conical-shaped ammunition magazines, the exterior envelope of the magazine may be rectilinear if necessary, depending on the size weight and transportation requirements of the magazine. In this manner, the magazine of the present invention may be designed to fit a pre-existing magazine storage can, or the like, as may be desirable for small caliber ammunition.

Figure 8:
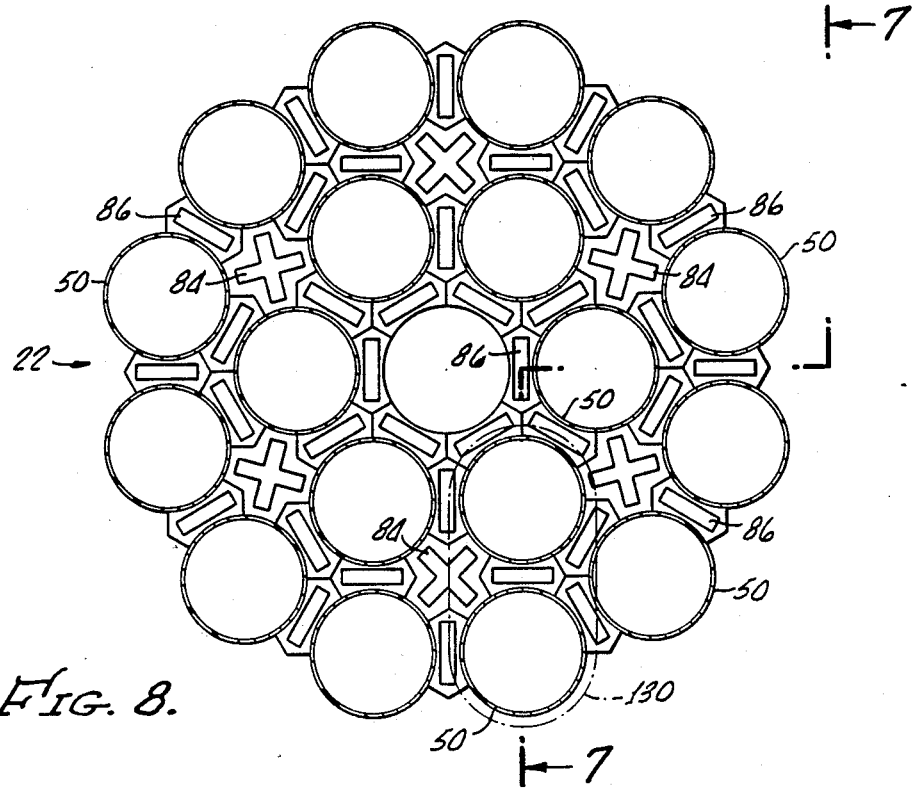
FIG. 8 is a transverse cross-section of the magazine showing position of fratricide elements.

Shown in FIG. 6, an individual canister 50 generally includes a body 70, with shaped portions 76, and a neck 78 to enable the canisters to be mounted to one another via the rings 54, 56 in a spaced apart relationship to enable fratricide elements 84, 86 to be inserted therebetween, if desired, as will hereinafter be discussed in connection with FIG. 8.

As hereinbefore indicated, the canister 50 is sized for the accommodation of a particular caliber of ammunition round, such as 120 mm, and may include a spring 90 secured by a retaining ring 92 and attached to a plunger 96 guided in a slot 98 for handling of an ammunition round 100. (See FIG. 5).

Turning now to FIG. 5, there is shown a magazine support structure 104 which provides means for mounting the plurality of attached modular canisters 50 for rotation about the centerline 74. End caps 106 (only one shown) may be provided which are inserted into ends 108 of the support structure 104 and support the canisters 50 along the centerline 74.

Also provided for rotating the canisters 50 about the centerline 74 is a motor 112, clutch 114, and drive train 116 coupled to a geneva cam driver 120 which engages geneva tracks 122 attached to rings 56 along a front 124 of the magazine 20. The motor, clutch, drive train 116, geneva cam driver 120 and geneva track 122 providing means for indexing the monocoque structure of the assembled canisters 50 so that each modular canister can be sequentially stopped at a preselected position for unloading or loading as hereinafter described.

Figure 7:
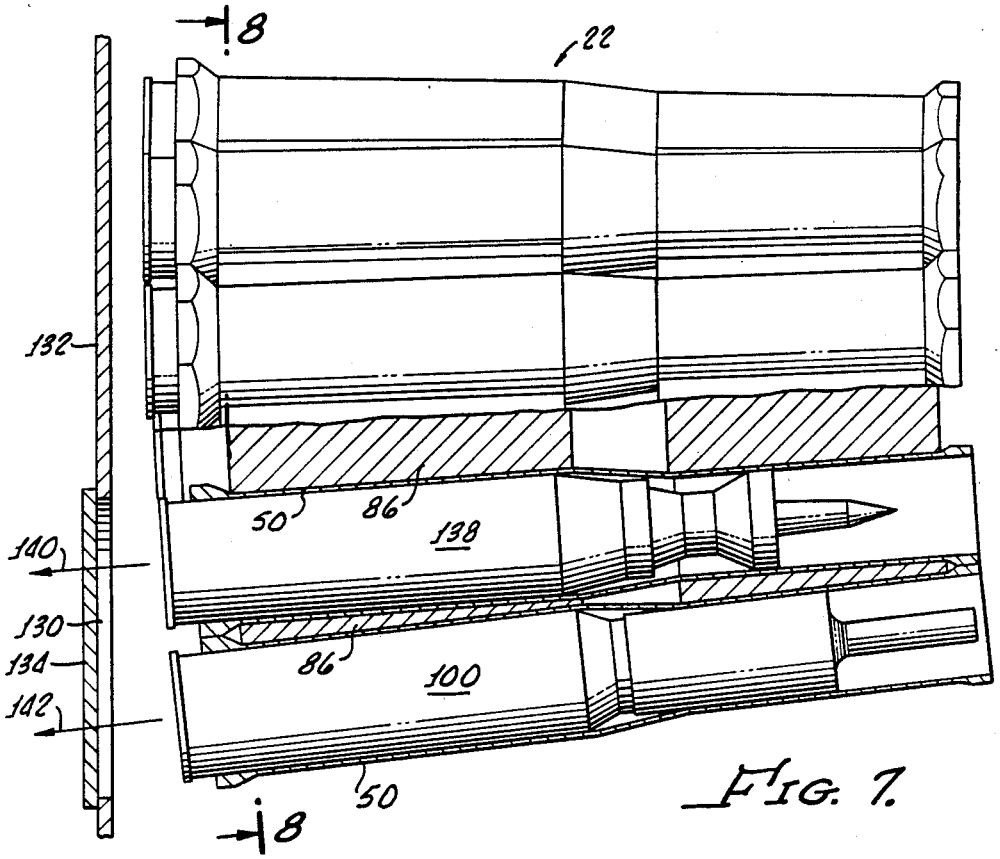
FIG. 7 is a cross-sectional view of the magazine of the present invention showing alignment of two modular canisters and ammunition therein with the ammunition port.

Turning now to FIG. 7, there is shown a cross-section of the ammunition magazine 30 as it is positioned for unloading through an ammunition port 130 disposed in a bulkhead 132 separating the turret 16 from the magazines 20, 22 and the exterior of the vehicle, see also FIG. 2. A door 134 is provided to cover the port 130 when ammunition is not being passed therethrough.

The hereinabove described geneva system provides means for indexing the ammunition rounds as they are rotated in order to align ammunition rounds 100, 138, which may be of various types, with the port 130 to enable automatic or manual removal of the ammunition rounds 100, 138 from the magazine 30 through the port in the direction of arrows 140, 142.

It should be readily apparent from FIG. 2 that the present ammunition system allows access to all of the ammunition rounds 100, 138 through a relatively small port 130, and the door 134 is significantly smaller than large sliding doors, (not shown), necessary in prior art ammunition systems.

As hereinbefore described, if the magazine is damaged in some manner, it can be rotated outwardly in the direction of arrow 140 (FIG. 2) and thereafter ejected, thereby protecting and limiting injury and damage to the personnel and vehicle itself.

A manual drive system 146, including a handle 148 and flexible drive 150 coupled to the motor 112 in a conventional manner may be provided for manual rotation of the magazine 20 in case of power failure.

As hereinabove briefly mentioned, the magazine of the present invention may also incorporate fratricide options by way of polyethylene covered steel in the form of stars, 84, or bars 86, inserted in the interstial areas between each of the magazine canisters 50. Although the materials of construction of the fratricide elements 84, 86, are of a conventional nature, the monocoque structure of the magazine 20, 30 of the present invention, enables the elements to be inserted between the canisters and totally trapped and mechanically restrained by the structure. It is important that no fasteners are necessary to hold the fratricide elements in place, hence, ensuring the reliability of fratricide element position within the magazine and additionally reducing the overall weight of the magazine.

Although there has been described hereinabove a specific ammunition magazine system in accordance with the present invention for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. An ammunition magazine system for a large caliber gun installed on a vehicle, said gun being mounted for loading from inside the vehicle, said ammunition magazine system comprising:

magazine means for supporting a plurality of ammunition rounds comprising a plurality of attached modular canisters, each modular canister being configured for supporting an ammunition round and having means for attaching each modular canister to other modular canisters to form a monocoque structure, said means for attaching each modular canister to other modular canisters comprising means for aligning the attached modular canisters in a circular array about a centerline of the ammunition magazine;

means attaching the magazine means to the vehicle for enabling the magazine means to be moved from a first position, at which ammunition rounds can be removed from the magazine means from within the vehicle, to a second position, at which ammunition rounds can be inserted into the magazine means from outside the vehicle, said means attaching the magazine means to the vehicle comprising hinge means for enabling the magazine to be rotated from the first to the second position; and means for separating the magazine means from the vehicle when the magazine means is in the second position.

2. The ammunition magazine assembly according to claim 1 wherein said means for attaching each modular canister to other modular canisters comprises a heptagon shaped ring disposed proximate each end of each modular canister.

3. The ammunition magazine assembly according to claim 2 further comprising mean for mounting the monocoque structure for rotation about a centerline thereof.

4. The immunition magazine assembly according to claim 3, further comprising anti-fratricide means disposed between each modular canister for retarding fratricidal detonation of ammunition rounds disposed in adjacent modular canisters.

5. An ammunition magazine assembly comprising:

a plurality of attached identical modular canisters, each modular canister being configured for supporting an ammunition round and having means for attaching each modular canister to other modular canisters to form a monocoque structure with an outside envelope of the ammunition magazine having a conical shape, said means for attaching each modular canister to other modular canisters comprising mounting ring means, disposed proximate each end of each modular canister, for attaching each modular canister to up to four other modular canisters.

6. The ammunition magazine assembly according to claim 5 wherein said means for attaching each modular canister to other modular canisters comprises means for aligning the attached modular canisters in a circular array about a centerline of the ammunition magazine.

7. The ammunition magazine assembly according to claim 6 wherein said means for attaching each modular canister to other modular canisters comprises means for removably attaching each modular canister to other modular canisters.

8. The ammunition magazine assembly according to claim 7 wherein said means for attaching each modular canister to other modular canisters comprises means for aligning each attached modular canister so that an axis of each modular canister is equidistant from the axis of adjacent modular canisters.

9. The ammunition magazine assembly according to claim 9 wherein said means for attaching each modular canister to other modular canisters comprises means for aligning the longitudinal axis of each modular canister in a non-parallel relationship.

10. The ammunition magazine assembly according to claim 9 wherein said means for aligning the longitudinal axis of each modular canister is configured for causing the longitudinal axes of the modular canisters to converge toward one another.

11. The ammunition magazine assembly according to claim 8 wherein said means for attaching each modular canister to other modular canisters comprises a heptagon shaped ring disposed proximate each end of each modular canister.

12. A modular ammunition canister comprising:

a generally cylindrical body configured for supporting an ammunition round therein; and attachment means for mounting the cylindrical body up to four other cylindrical bodies, identical to said first mentioned cylindrical body, in a honeycomb pattern, said attachment means comprising means for aligning each cylindrical body in a circular array with the other cylindrical bodies about a centerline of the honeycomb pattern, said attachment means comprising a heptagon shaped ring disposed proximate opposite ends of each cylindrical body.

13. The ammunition canister according to claim 12 wherein said attachment means comprises means for removably attaching each cylindrical body to the other cylindrical bodies.

14. The ammunition canister according to claim 13 wherein the cylindrical body includes a front neck portion and a rear portion, said front neck portion having a smaller diameter having said rear portion, and said ammunition canister further comprises spring means disposed in said front neck portion for maintaining an ammunition round in compression within the cylindrical body.

15. An ammunition magazine assembly comprising a monocoque structure formed by the attachment of more than one ammunition canister as set forth in claim 14.

16. An ammunition magazine assembly comprising:

a plurality of attached modular canisters, each modular canister being configured for supporting an ammunition round and having means for attaching each modular canister to other modular canisters to form a monocoque structure, said means comprising a heptagon shaped mounting ring disposed proximate each end of each modular canister.

17. A modular ammunition canister comprising:

a generally cylindrical body configured for supporting an ammunition round therein; and attachment means for mounting the cylindrical body to a plurality of other cylindrical bodies identical to said first mentioned cylindrical body in a honeycomb pattern, said attachment means comprising a heptagon shaped mounting ring disposed proximate each end of said generally cylindrical body.

* * * * *